United States Patent [19]

Bujtas et al.

[11] Patent Number: 4,990,096

[45] Date of Patent: Feb. 5, 1991

[54] APPARATUS FOR MATING, UNMATING AND HOLDING DOWN ELECTRONIC EQUIPMENT

[75] Inventors: Geza Bujtas, Boonton; Robert Hupp, Manville; Donald Proefrock, Hackettstown, all of N.J.

[73] Assignee: Smiths Industries, Florham Park, N.J.

[21] Appl. No.: 541,136

[22] Filed: Jun. 20, 1990

[51] Int. Cl.[5] ..... H01R 13/62

[52] U.S. Cl. ..... 439/157

[58] Field of Search ..... 439/152–160

[56] References Cited

U.S. PATENT DOCUMENTS 4,606,591 8/1986 Bloch ..... 439/157

4,869,678 9/1989 Schwenk ..... 439/157

*Primary Examiner*—Joseph H. McGlynn

*Attorney, Agent, or Firm*—Anthony J. Casella; Gerald E. Hespos

[57] ABSTRACT

An apparatus is provided for mating and unmating electronic equipment to a rack in an associated electrical or electromechanical system. The apparatus is further operative to hold the electronic equipment in a mated condition to prevent separation during severe vibration or shock. The apparatus includes an actuator for moving a plurality of latches which engage hold-down brackets on the electronic equipment. The engagement of the latches on the apparatus and the hold-down brackets enables insertion, withdrawal and holding down of the electronic equipment in the rack. A clutch assembly is provided to prevent over-insertion of the electronic equipment into the rack.

19 Claims, 3 Drawing Sheets

APPARATUS FOR MATING, UNMATING AND HOLDING DOWN ELECTRONIC EQUIPMENT

BACKGROUND OF THE INVENTION

A mateable pair of electrical terminals comprises a first terminal disposed to engage at least one contact beam of a second terminal. A good electrical connection requires the terminals to exert a contact force against one another. These contact forces between mated terminals typically are derived from the resiliency of the metal from which the terminals are formed. In particular, terminals may be aligned to deflect during mating, and the resiliency of the metal will urge the deflected terminals back toward an undeflected condition, thereby generating the contact forces.

An over-insertion of two mateable connectors can cause contact beams of terminals in one of the connectors to deflect beyond a point at which they will resiliently return to an undeflected condition. This over-insertion and over-deflection may prevent the contact beams from exerting the required contact force against the mated terminal. Alternatively, such over-deflection can damage the connector housing or otherwise shorten the life of the connector.

The deflection of a contact beam which occurs during mating requires the generation of an insertion force. Similarly, the unmating of two electrically conductive terminals requires the exertion of a withdrawal force to overcome the normal contact force between the terminals.

Most electrically conductive terminals are very small, and therefore require reasonably low insertion and withdrawal forces. Consequently, it is generally easy to mate small electrical connectors having only a few pairs of mateable terminals. Many electrical connectors, however, comprise a large number of pairs of mateable terminals. The insertion force required for such multi-terminal connectors is the sum of the insertion forces of the various pairs of mated terminals therein. Thus, insertion forces increase in proportion to the number of terminals in a connector. Some electrical apparatus comprise modular subassemblies of electronic equipment having complex arrays of electrical components and a plurality of multi-terminal connectors. For example, a modular subassembly may comprise a plurality of circuit boards extending from a panel to which a plurality of multi-terminal electrical connectors are mounted. Modular subassemblies such as these may be referred to as drawers and may be insertable into a rack or cavity in an electrical or electromechanical apparatus. The various connectors mounted on the panel of the modular subassembly typically are simultaneously mated with a corresponding array of connectors in the rack. The sum of the insertion forces for the many terminals in such modular subassemblies of electronic equipment often will be very high and may require mechanical means for assisting the technician who carries out the mating.

The mating of the electrical connectors often occur at an inaccessible location within an apparatus. The technician performing this blind mating often cannot be certain that the several electrical connectors mounted to the modular subassembly are properly aligned for mating. As a result, the modular subassemblies being inserted into a rack may comprise guide means for facilitating alignment of the connectors, and the respective connectors may be floatably mounted to the panel to overcome any initial misalignment. Frictional forces of the guide means and biasing forces of the electrical connector float means further contribute to the insertion forces.

Many modular subassemblies of electronic equipment are used in aircraft, ground vehicles or machines that generate vibrations or that are subject to physical shock. As a result, the individual terminals in the complex modular assemblies must be constructed to exert high normal contact forces for achieving adequate electrical connection through all ranges of anticipated vibrations and shock. Thus, the total insertion force for such modular subassemblies or drawer connectors used in high vibration environments may be very high.

The prior art includes mechanical means for assisting the technician performing the mating of the above described modular subassemblies of electronic equipment. The prior art mating assistance means typically has included a lever for urging the modular subassembly into a rack or a cavity of the electrical or electromechanical apparatus. These simple lever arrangements typically have not been adapted to facilitate removal of these complex modular subassemblies. Thus, the technician was left to employ brute force to effect the removal or to employ available tools to assist in the initial unmating of the modular subassembly. The tools employed by technicians for attempting removal of a modular assembly can damage the subassembly of costly electronic equipment, thereby requiring down-time and increasing maintenance costs. The prior art lever apparatus for facilitating insertion of the modular subassemblies of electronic equipment has generally not included means for preventing over-insertion. In many instances, the forces generated by the lever would exceed the mating forces specified for selected terminals in the assembly or for the plastic housings in which the terminals are mounted.

The prior art has included pairs of parallel threaded means for urging a modular subassembly into a rack or the mating cavity of an apparatus. These prior art arrangements have required either the simultaneous use of two tools by the technician or alternating incremental advancement of the threaded means for slowly moving the drawer or modular subassembly into the rack or the cavity of the apparatus. These prior art multi-screw systems have required either exceptional dexterity for the technician to simultaneously use two tools, or have required a slow insertion process where alternate screws are incrementally advanced. The incremental alternate advancement of parallel screws would often skew the modular subassembly relative to the rack and thereby create the potential for damage to the expensive equipment. Systems of this type have been particularly vulnerable to either incomplete mating or over-insertion since the threaded insertion means provide no readily recognizable indication of complete insertion.

Modular subassemblies of electronic equipment and drawer connector assemblies employed in high vibration environments, such as aircraft or land vehicles may desirably include means for retaining the drawer or other such modular subassembly in the apparatus. Prior art systems of this type have included latch means that are structurally and functionally separate from any mating or unmating assistance apparatus that may also be provided.

In view of the above, it is an object of the subject invention to provide a apparatus for efficiently assisting in the mating of drawer connectors or other such modular subassemblies of electronic equipment.

It is another object of the subject invention t provide an efficient means for unmating drawer connectors and other such modular subassemblies of electronic equipment.

An additional object of the subject invention is to provide mating and unmating assistance means that ensures parallel movement of the subassembly along a mating axis.

Still a further object of the subject invention is to provide a mating and unmating assistance apparatus that further functions to retain the modular subassembly of electronic equipment in a mated condition within an apparatus.

Yet another object of the subject invention is to provide a mating and unmating apparatus for modular subassemblies of electronic equipment that is easy to employ and inexpensive to manufacture.

An additional object of the subject invention is to provide a mating and unmating system that prevents damage from over-insertion or excessive mating forces.

SUMMARY OF THE INVENTION

The subject invention is directed to apparatus for mating and/or unmating a modular subassembly of electronic equipment into an electrical or electromechanical apparatus. The modular subassembly of electronic equipment may define a drawer connector having a forward mating panel with a plurality of electrical connectors mounted thereto. At least one of the electrical connectors may be a multi-terminal connector. The apparatus with which the modular subassembly of electronic equipment is mateable may be a portion of an aircraft, a vehicle or complex telecommunications equipment.

The apparatus of the subject invention comprises actuator means for effecting relative movement between the modular subassembly of electronic equipment and the apparatus with which the subassembly is mateable. The actuator means may comprise clutch means for preventing exertion of excessive force on the electrical connectors during mating. The clutch means may comprise a yieldable connection that may be unidirectional and inoperative during unmating of the subassembly from the apparatus. The actuator means may comprise a rotatable actuator having threaded means for generating an axial force on the modular subassembly of electronic equipment in response to rotational forces on the actuator. The rotational forces may be applied to the actuator with conventional tools, such as an Allen wrench, a socket wrench or the like. Alternatively, a motorized actuator may be provided to generate mating and unmating forces. Preferably, only a single actuator is provided for each subassembly to simplify the application of forces for mating or unmating. However, it also is preferred to apply forces to the subassembly substantially uniformly across a surface extending generally transverse to the mating direction. In this regard, the apparatus may comprise a transverse connecting bar cooperating with the actuator and operative to exert forces at a plurality of locations spaced symmetrically with respect to the mating axis.

The apparatus of the subject invention may be operative to both insert the modular subassembly of electronic equipment and to remove the modular subassembly. In particular, the apparatus may comprise a pusher means for exerting a pushing force on the modular subassembly to achieve mating, and a puller means for selectively exerting a pulling force on the modular subassembly to achieve unmating. The pusher means and the puller means may define portions of a latch, hook or other such mechanical apparatus. To ensure uniform pushing and pulling forces, and to thereby avoid skewing of the modular subassembly of electronic equipment during mating and unmating, the apparatus may comprise a plurality of combined pusher/puller means disposed symmetrically with respect to the mating axis. For example, the actuator may be disposed generally centrally along the mating axis, while the pusher/puller means may be disposed substantially equal distances on opposite sides of the actuator. With this construction, the actuator may be connected to the pusher/puller means by a transverse connecting bar for uniformly delivering forces from the actuator to the pusher/puller means.

The apparatus of the subject invention may further comprise hold-down means for securely retaining the modular subassembly of electronic equipment in a mated condition. The hold-down means may be particularly important in high vibration environments, such as environments encountered in many vehicles and aircraft. The hold-down means preferably comprises means for selective connection and disconnection such that the hold-down means does not prevent efficient mating and unmating of the electrical subassembly. In this regard, the hold-down means may define portions of a latch or hook apparatus for selectively exerting mating or unmating forces. The hold-down means may comprise a plurality of means for securely retaining the modular subassembly of electronic equipment in a mated condition and thereby to prevent skewing of the subassembly and partial unmating thereof in response to excessive vibrations.

In a preferred embodiment, as explained further herein, mating forces, unmating forces and hold-down forces may be provided by latches that are mounted for selective pivoting and translation. Each latch may comprise pushing means, hold-down means and pulling means which may be defined by one or more surfaces on each latch. Each latch may further comprise means for controlled translation relative to the mating direction to enable disengagement of the hold-down means at a selected point during unmating for facilitating complete separation of the modular subassembly from the electrical apparatus. Similarly, the translation of the latch permits the modular subassembly to be initially inserted into the electronic or electromechanical apparatus without interference with the latch, but subsequently enables selective engagement of the latch with the subassembly to complete the mating process. The apparatus of the subject invention preferably is configured to control the ranges of movement of the latch to prevent unintended contact between the latch and sensitive electronic equipment that may be disposed adjacent thereto.

DETAILED DESCRIPTION OF THE PREFERRED EMBODIMENT

Figure 1:
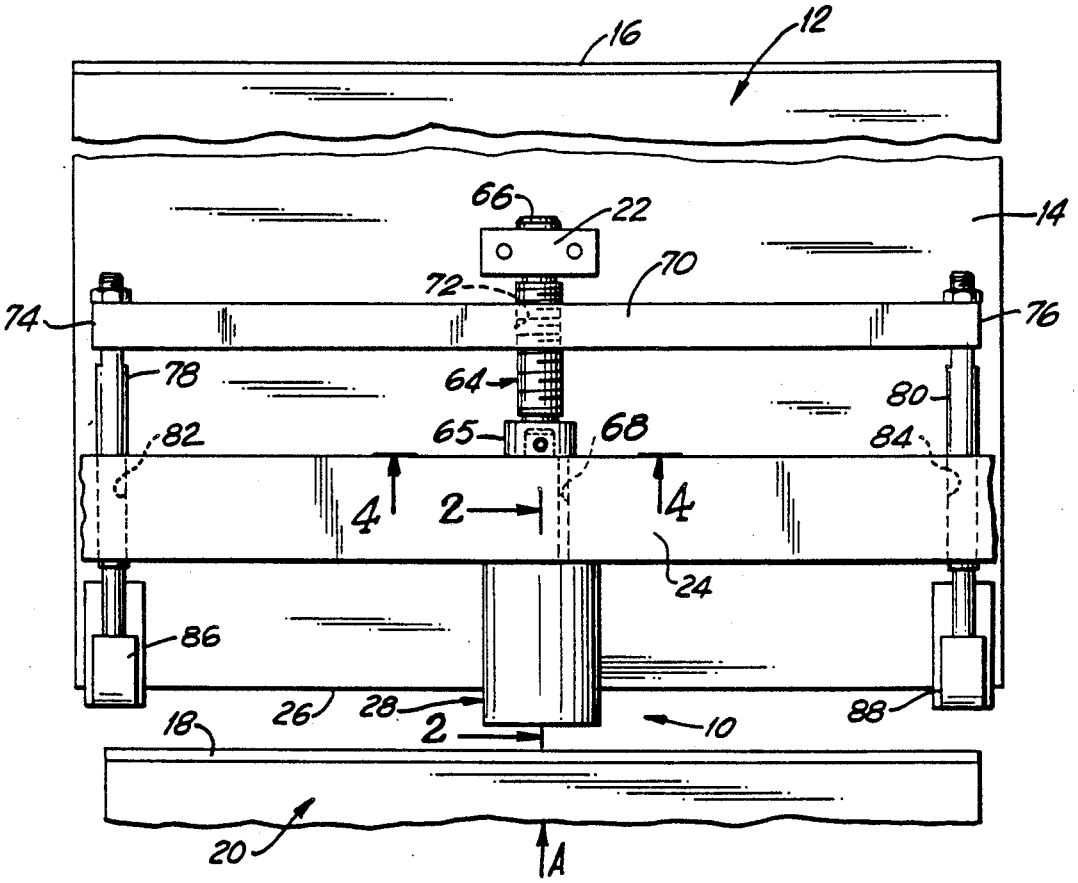
FIG. 1 is a top plan view of an apparatus in accordance with the subject invention.
Figure 2:
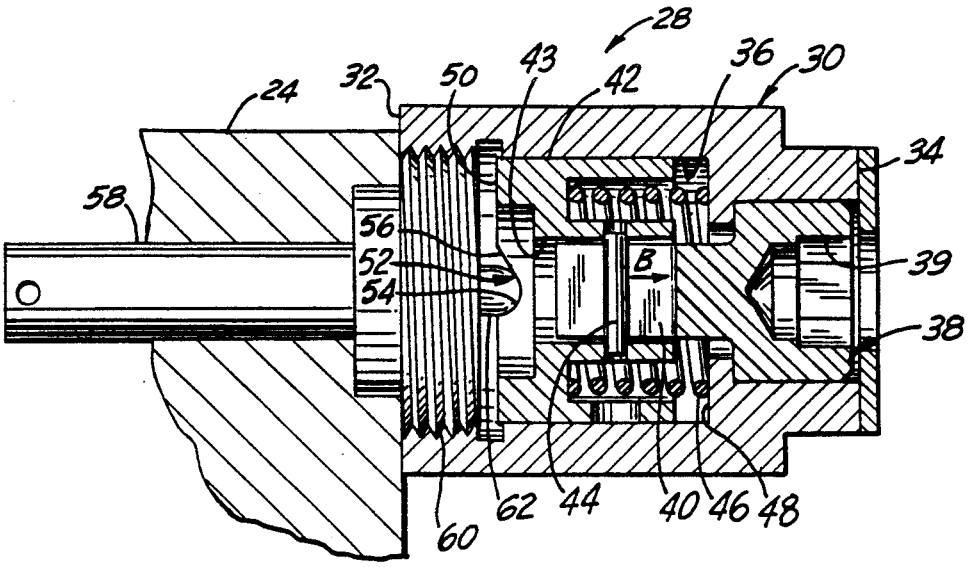
FIG. 2 is a cross-sectional view taken along line 2—2 in FIG. 1.
Figure 3:
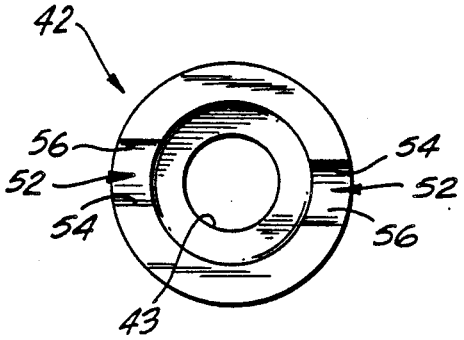
FIG. 3 is an end elevational view of the pressure plate shown in FIG. 2.

The apparatus of the subject invention is identified generally by the numeral 10 in FIGS. 1–7. The apparatus !0 is rigidly mounted in proximity to a rack 12 which may define a portion of the electrical system for an airplane, land vehicle, ship or complex telecommunication systems. The rack 12 defines a mating cavity or channel 14 leading to a panel 16 having an array of electrical connectors (not shown) mounted thereto. The connectors on the panel 16 are arrayed to mate with corresponding connectors on a panel 18 of a modular subassembly of electronic equipment 20. The electronic equipment 20 is dimensioned to be slidably inserted into the mating cavity or channel 14 of the rack 12. As explained herein, the apparatus 10 is operative to achieve the mating of the connectors on the panel 18 of the electronic equipment 20 with the corresponding connectors on the panel 16 of the rack 12. Additionally, the apparatus 10 is operative to hold the electronic equipment 20 in the rack 12 to prevent unintended separation in response to severe vibration or shock, and further to facilitate intentional separation for repair or replacement of components within the modular subassembly of electronic equipment 20.

The apparatus 10 comprises a bushing block 22 and a transverse support block 24 which are mounted to the rack 12 generally adjacent the mating cavity or channel 14. The bushing block 22 is mounted at a central location in the mating channel 14 generally in proximity to the panel 16 of the rack 12 and spaced rearwardly from the entrance 26 to the mating channel 14. The transverse support block 24 extends substantially orthogonally to the mating axis, as indicated by arrow "A" and generally adjacent the entrance 26 to the mating channel 14 of the rack 12. The bushing and support blocks 22 and 24 respectively define the fixed connections to the rack 12 relative to which other operative components of the apparatus 10 move, as explained further below.

The apparatus 10 further includes an actuator 28 rigidly connected to the transverse support block 24 at a central location therealong. The actuator 28, as shown more clearly in FIG. 2, includes a rigid housing 30 having a rear end 32 mounted in proximity to the transverse support block 24 and a front end 34 extending forwardly from the transverse support block 24 and accessible in proximity to the entrance 26 to the mating cavity 14 of the rack 12. The housing 30 includes a stepped cylindrical through aperture 36 extending therethrough.

A rotatable drive member 38 is mounted in the central through aperture 36 of the housing 30 adjacent the forward end 34 thereof. The rotatable drive member 38 has a head 39 configured to receive an Allen wrench, and a rear end with a longitudinal slot 40. A pressure plate 42 is mounted in the through aperture 36 of the housing 30 intermediate the opposed rear and front ends 32 and 34 respectively. The pressure plate 42 includes a central through aperture 43 in which the slotted rear end of the rotatable drive member 38 is slidably disposed. However, the rotatable drive member 38 and the pressure plate 42 ar maintained in fixed rotational alignment by a pin 44. A coil spring 46 is disposed intermediate the pressure plate 42 and a step 48 in the through aperture 36 of the housing 30. The spring 46 is operative to urge the pressure plate 40 generally toward the rear end 32 of the housing 30. However, the relative axial dimensions of the pressure plate 42 and the housing 30 enable the pressure plate 42 and pin 44 to move forwardly in a direction indicated by arrow "B" in FIG. 2 relative to the slotted rear end of the rotatable drive member 38 and against the force exerted by the spring 46.

The pressure plate 42 includes a generally annular rear axial end 50 which defines the end thereof opposite the spring 46. Diametrically opposed regions of the rear axial end 50 are defined by notches 52, as shown in both FIGS. 2 and 3. Each notch 52 includes an unmating side 54 extending generally parallel to the longitudinal axis and a mating side 56 which is angularly aligned to the unmating side 52. The combination of the mating side 56 of each notch 52 and the ability of the pressure plate 42 to move forwardly against the action of the spring 46 enables the actuator 28 to function as a slip clutch that prevents excessive insertion forces. This operation is explained in greater detail below.

The actuator 28 further includes a clutch shaft 58 extending rearwardly from the rear end 32 of the housing 30. The clutch shaft 58 includes a forward end 60 disposed within the housing 30 and having an arcuate projection 62 dimensioned to engage the notches 52 in the pressure plate 42. The projection 62 will securely rotate with the pressure plate 42 in response to driving forces exerted by the unmating side 54 of each notch 52. The projection 62 will also rotate in response to relatively low forces exerted by the mating side 56 of each notch 52. However, significant resistance between the projection 62 and the insertion side 56 of each notch 52 may cause the entire pressure plate 42 to move in a forward direction "B" and against the action of the spring 46, thereby causing a slippage. The level of force required for such a slippage is determined by the force characteristics of the spring 46. As will be explained further herein, the slippage between the notch 52 of the pressure plate 42 and the projection 62 of the clutch shaft 58 will occur after complete mating has been achieved and will prevent any additional forces from damaging either the electronic equipment 20 or the connectors mounted to the panel 16 of the rack 12.

Figure 4:
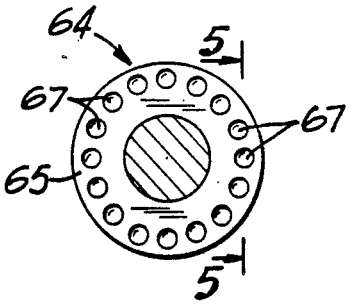
FIG. 4 is a cross-sectional view taken along line 4—4 in FIG. 1.
Figure 5:
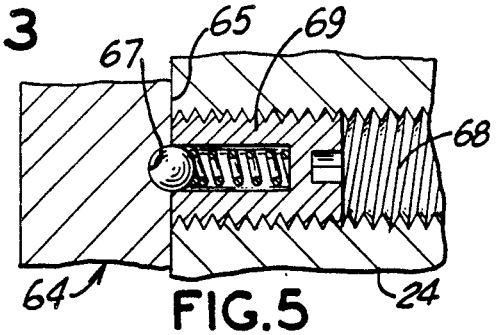
FIG. 5 is a cross-sectional view taken along line 5—5 in FIG. 4.

Returning to FIG. 1, a threaded rod 64 is provided with a forward end 65 that is nonrotatably mounted to the clutch shaft 58 and a rearward end 66 that is rotatably mounted in the bushing block 22. Thus, the threaded rod 64 rotates in unison with the clutch shaft 58, which in turn is rotated by rotatable drive member 38 and an Allen wrench or the like. The front face of the forward end 65 is characterized by an annular array of arcuate recesses 67 as shown in FIGS. 4 and 5. The recesses 67 are disposed at a radial distance to be in line with a threaded aperture 68 in the transverse support block 24. A spring loaded detent 69 is threadedly mounted in the aperture 68 and is operative to engage one of the recesses 67 in the forward end 65 of the threaded rod 64. The engagement of the spring loaded detent 69 with a recess 67 will prevent unthreading in response to vibrations. However, forces of the spring loaded detent 69 against the recess 67 can be overcome by forces applied to the rotatable drive member 38. The resistance to vibration can be varied by threadedly advancing or retracting the spring loaded detent in the threaded aperture 68 of the support block 24.

A transverse connecting bar 70 includes a threaded aperture 72 at a central portion thereof. The threaded aperture 72 is threadedly engaged with the threaded rod 64. The connecting bar 70 further includes opposed ends 74 and 76 respectively, with shafts 78 and 80 being securely connected to the connecting bar 70 adjacent the opposed respective ends 74 and 76 thereof. The shafts 78 and 80 extend substantially parallel to the threaded rod 64 in forward directions from the transverse connecting bar 70, and extend slidably through unthreaded apertures 82 and 84 respectively in the transverse support block 24. The shafts 78 and 80 are connected to substantially identical latch mechanisms 86 and 88 at locations forwardly of the support block 24. The slidable engagement of the shafts 78 and 80 in the apertures 82 and 84 respectively of the support block prevent rotation of the transverse connecting bar 70 about the threaded rod 64. As a result, rotation of the threaded rod 64 will cause the transverse connecting bar 70 to move along the mating axis and will generate corresponding slidable movement of the shafts 78 and 80 through the unthreaded apertures 82 and 84 in the transverse support block. The direction of movement of the shafts 78 and 80 and the transverse connecting bar 70 will depend upon the direction of rotational movement of the threaded rod 64, which in turn is dependent upon the direction of rotation of the rotatable drive member.

Figure 6:
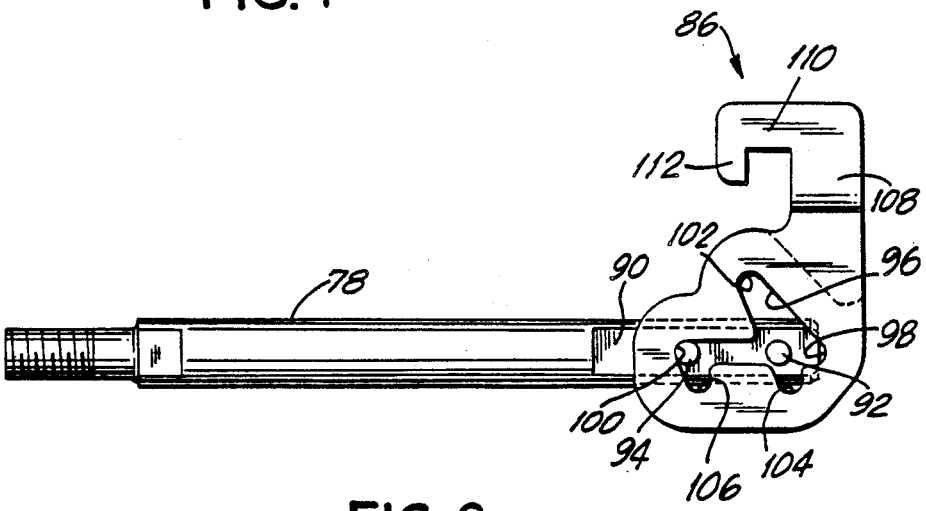
FIG. 6 is a side elevational view of the latch and shaft of the subject invention.
Figure 7:
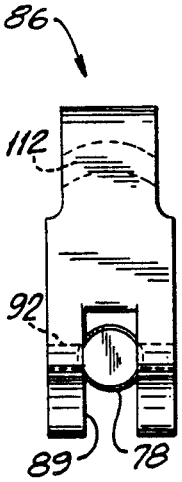
FIG. 7 is an end elevational view of the latch and shaft of FIG. 6.

The latch mechanism 86 is depicted more clearly in FIGS. 6 and 7. It is to be understood that the structure described in detail herein with respect to the latch 86 also exists on the identical latch 88. More particularly, the latch 86 includes a slot 89 through which the end 90 of the shaft 78 extends. Forward and rearward pins 92 and 94 respectively extend from the shaft 78 and through aperture 96 in the slotted portion of the latch 86.

The aperture 96 in the latch 86 defines a forward pivot location 98 which engages the forward pin 92 to exert forces on the electronic equipment 20 during unmating or removal from the rack 12. A rear pivot location 100 of the aperture 96 engages the rear pin 94 during mating or inserting the electronic equipment 20 into the rack 12. Additionally, the pivotable engagement of the rear pin 94 and the rear pivot location !00 functions to hold the electronic equipment 20 in fixed mated relationship in the rack 12 to prevent unintentional separation in response to severe vibration or shock. The aperture 96 further includes a forward support location 102 which is offset upwardly from the pivot locations 98 and 100 to enable engagement of the forward pin 92 when the latch 86 has been disengaged from the electronic equipment 20. In particular, as shown more clearly in FIG. 8, the forward support location 102 of the aperture 96 prevents the latch mechanism 86 from swinging freely into an alignment that conceivably could interfere with other modules of electronic equipment engaged in the rack 12. The aperture 96 is still further defined by forward and rearward cutouts 104 and 106 which, as shown in FIGS. 8 and 9, are disposed and dimensioned to selectively engage the forward and rear pins 92 and 94 to enable translation of the latch 86 which in turn enables separation of the latch 86 from the electronic equipment 20.

Figure 9:
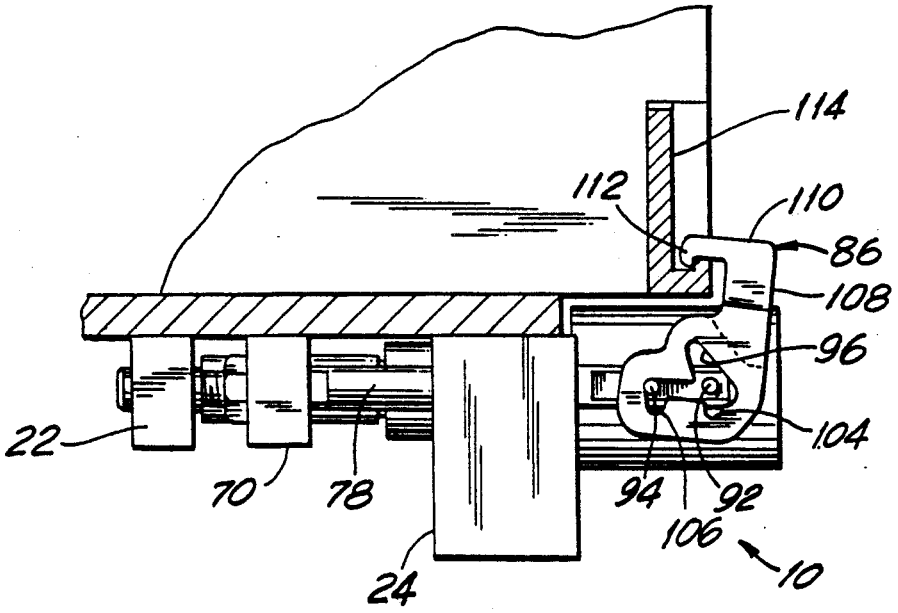
FIG. 9 is side elevational view similar to FIG. 8 showing the modular subassembly of electronic equipment in a fully mated condition.

The latch mechanism 86 is further defined by a connecting arm 108 extending upwardly from the aperture 96 and toward the electronic equipment 20, as shown in FIGS. 6 and 9. The end of the arm 108 remote from the aperture 96 includes a rearwardly directed pulling arm 110 which terminates in a hook 112. The pulling arm 110 and the hook 112 are configured and dimensioned to engage hold-down bracket 114 which are rigidly mounted to the forward face of the electronic equipment 20. As illustrated most clearly in FIG. 7, the hook 112 of the latch 86 is arcuately concave from side to side to ensure positive gripping of the hold-down bracket 114 during insertion, withdrawal and hold-down operations.

Figure 8:
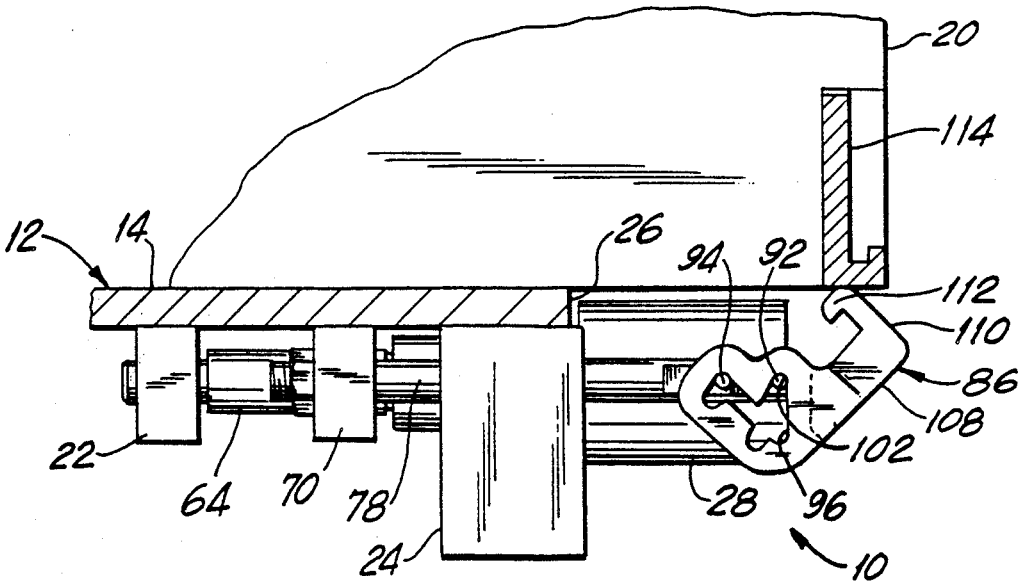
FIG. 8 is a side elevational view of the apparatus showing a modular subassembly of electronic equipment partly inserted into a rack.

The apparatus 10 is placed in the condition depicted in FIG. 8 to enable insertion or removal of the modular subassembly electronic equipment 20 into the rack !2. More particularly, in the orientation depicted in FIG. 8, the rotatable drive member 38 of the actuator 30 is rotated counterclockwise to its maximum amount, such that the transverse connecting rod 70 and shafts 78 and 80 connected thereto are advanced forwardly relative to the rack 12. Additionally, the latches 86 and 88 are pivoted such that the upper and rearward support portions 102 and 100 respectively are engaged by the forward and rearward pins 92 and 94 respectively. This orientation of the latches 86 and 88 enables an initial insertion of the electronic equipment 20 into the mating channel 14 of the rack 12.

Once the hold-down bracket 114 of the electronic equipment 20 clears the latch 86, the latch 86 may be translated and rotated such that the pins 92 and 94 are engaged in the notches 104 and 106 of the aperture 96. The pulling arm 110 and the hook 112 of the latch mechanism 86 is then engaged over the hold-down bracket 114 as shown in FIG. 9. The rotatable drive member 38 of the actuator 30 is then advanced clockwise to cause the transverse connecting bar 70 to move rearwardly along the threaded rod 64. This rearward movement of the connecting bar 70 exerts even pulling forces on the shafts 78 and 80 and the respective latches 86 and 88. As a result, the hook mechanisms exert a uniform insertion force on the modular subassembly of electronic equipment 20 to enable mating of the connectors on the panel 18 of the electronic equipment 20 with the corresponding connectors on the panel 16 in the rack 12. After complete mating has been achieved, the apparatus 10 will encounter higher forces from the rack 12. These greater resistant forces will cause the pressure plate 42 to slip over the projection 62 on the clutch shaft 58. As a result, continued rotation of the rotatable drive member 38 will not cause any damaging over-insertion of the electronic equipment 20. In this fully inserted condition, the forces of the latch 86 on the hold-down bracket 114 of the electronic equipment 20 will prevent the electronic equipment 20 from being vibrated free of the rack 12.

The apparatus 10 is employed to remove the electronic equipment 20 from the rack 12 by merely rotating the rotatable drive member 38 in a counterclockwise direction. This rotation of the drive member 38 generates a corresponding rotation of the threaded rod 64 and causes both the transverse connecting bar 70 and the shafts 78 and 80 to move in a forward direction. This forward movement of the shafts 78 and 80 causes the hook 112 of the latch mechanism 86 and the corresponding hook (not shown) of the latch mechanism 88 to exert uniform pulling forces on the hold-down brackets 114 of the electronic equipment. The clutch is not operative in this direction, and hence the necessary unmating forces can be generated. At a selected point during this withdrawal, the latches 86 and 88 can be translated and rotated to disengage the hook 112 of the latch mechanism 86 from the hold-down brackets 114. The latch 86 can then be allowed to hang from the pins 92 and 94 as depicted in FIG. 8.

While the invention has been defined with respect to a preferred embodiment, it is apparent that various changes can be made without departing from the scope of the invention as defined by the appended claims. For example, actuating means other than an Allen wrench socket may be provided, different clutch operations may be employed and more or fewer latch mechanisms may be used in accordance with physical characteristics of the electronic equipment and rack. These and other changes will be apparent to a person skilled in this art after having read applicant's disclosure.

We claim:

1. Apparatus for use with an electrical assembly and a modular subassembly of electronic equipment, said modular subassembly being selectively movable along a mating axis in a mating direction toward the electrical assembly for electrically mating therewith and alternatively in an unmating direction away from the electrical assembly for unmating, said apparatus being operative to assist in the mating and the unmating of the modular subassembly with the electrical assembly, and comprising:

actuator means mounted in proximity to the electrical assembly for generating forces along the mating axis selectively in either of the mating and the unmating directions;

connecting means operatively connected to the actuator for movement along the mating axis in response to the forces generated by the actuator;

a plurality of latch means operatively connected to the connecting means and selectively engageable with the modular subassembly at a corresponding plurality of locations thereon for exerting substantially uniform forces on the modular subassembly, whereby the selective engagement of the modular subassembly by the latch means and the selective actuation of the actuator relative to the electrical assembly urge the latch means and the modular subassembly engaged thereby selectively towards and away from the electrical assembly for achieving mating and unmating therewith.

2. Apparatus as in claim 1 wherein the actuator means comprises threaded means selectively rotatable about an axis extending substantially parallel to the mating axis for generating said forces.

3. Apparatus as in claim 1 wherein the actuator means comprises clutch means for preventing exertion of excessive force on the modular subassembly during mating.

4. Apparatus as in claim 3 wherein the clutch means further comprises a pressure plate selectively movable along the mating axis, spring means for exerting spring forces on the pressure plate for urging the pressure plate in first direction along the mating axis, and yieldable connection means between the pressure plate and the connecting means for interrupting forces applied to the modular subassembly in response to resistance forces in excess of the spring forces.

5. Apparatus as in claim 4 wherein the yieldable connection means of the clutch means comprises a member having a transversely extending groove with a first side parallel to the mating axis and a second side aligned at an acute angle to the mating axis, the first side being disposed to ensure consistent application of force for withdrawing the modular subassembly from the electrical assembly, the angularly aligned second side of the clutch means being disposed to slip during mating in response to insertion forces in excess of the spring forces.

6. Apparatus as in claim 1 wherein the actuator means comprises an array of threads rotatable about a axis extending generally parallel to the mating axis, the array of threads of the actuator means being threadedly engaged with the connecting means such that rotation of the array of threads of the actuator means generates movement of the connecting means parallel to the mating axis.

7. Apparatus as in claim 6 wherein the array of threads of the actuator means is mounted for rotation in a fixed axial position along the mating axis.

8. Apparatus as in claim 6 wherein the connecting means defines a rigid bar extending orthogonal to the mating axis, said bar being threadedly engaged with the array of threads of the actuator means at a substantially central location along the bar.

9. Apparatus as in claim 8 wherein the connecting means further defines shafts connected to the bar at substantially equally spaced locations from the actuator means, said shafts being operatively connected to the latch means for moving the latch means in response to movement of the bar.

10. Apparatus as in claim 1 further comprising hold-down brackets rigidly mounted to the modular subassembly, said latch means being selectively engageable with the hold-down brackets for alternately urging the modular subassembly toward and away from the electrical assembly for mating and unmating respectively.

11. Apparatus as in claim 10 wherein the latch means are pivotably connectable to the connecting means for permitting selective engagement and disengagement of the latch means with the hold-down brackets of the modular subassembly.

12. Apparatus as in claim 11 wherein the latch means are selectively translatable in a direction angularly aligned to the mating axis for facilitating selective engagement and disengagement of the latch means with the hold-down brackets.

13. An apparatus for use with an electrical assembly and a modular subassembly, said electrical assembly and said modular subassembly comprising a plurality of pairs of mateable electrical connectors, said modular subassembly being selectively movable along a mating axis toward the electrical assembly to achieve mating of the pairs of electrical connectors thereof, and further being selectively movable along the mating axis away from the electrical assembly for achieving unmating thereof, said apparatus comprising:

an actuator having a housing fixedly mounted relative to the electrical assembly, and a threaded shaft rotatable about an axis extending parallel to the mating axis;

a transverse connecting bar threadedly engaged with the threaded rod of the actuator such that rotation of the threaded rod of the actuator generates movement of the transverse connecting bar in a direction parallel to the mating axis;

a plurality of shafts rigidly connected to the transverse connecting bar and extending therefrom generally parallel to the mating axis;

a plurality of latches mounted respectively to the shafts at locations thereon remote from the transverse connecting bar, said latches being movable relative to the respective shafts for selective engagement with the modular subassembly, whereby rotation of the threaded rod of the actuator generates movement of the transverse connecting bar, the shafts and the latches in directions parallel to the mating axis, and whereby engagement of the latches with the modular subassembly enable movement of the subassembly along the mating axis for selective mating and unmating.

14. An apparatus as in claim 13 wherein the movable mounting of the latches to the respective shafts comprises means for selectively pivoting the latches and means for translating the latches relative to the associated shaft.

15. An apparatus as in claim 13 wherein the actuator comprises a slip clutch connection for preventing exertion of forces in a mating direction beyond threshold level of forces.

16. An apparatus as in claim 13 wherein each said shaft comprises a plurality of pins to which the associated latch is mounted such that said pins permit controlled pivoting of the latch relative to the shaft for enabling selective engagement of the latch with the modular subassembly while preventing interference of the latch with adjacent portions of the electrical assembly.

17. An apparatus as in claim 16 wherein each said latch comprises a plurality of notches selectively alignable with the pins of the associated shaft, said notches permitting translation of the latch relative to the shaft for disengaging the latch from the modular subassembly.

18. An apparatus for use with an electrical assembly and a modular subassembly of electronic equipment, said modular subassembly being selectively movable along a mating axis in a mating direction toward the electrical assembly for electrically mating therewith and alternately in an unmating direction away from the electrical assembly for unmating, said apparatus being operative to assist in the mating and the unmating of the modular subassembly with the electrical assembly, said apparatus comprising:

an actuator having a rotatable drive means selectively rotatable in clockwise and counterclockwise directions;

a slip clutch interconnection operatively connected to the rotatable drive means for rotation therewith, said slip clutch interconnection being operative to rotationally slip relative to the rotatable drive means in response to forces corresponding to complete insertion of the modular subassembly of electronic equipment in the electrical assembly, said slip clutch interconnection further comprising thread means extending generally parallel to the mating axis;

a transverse connecting bar threadedly engaged with the threaded portion of the slip clutch interconnection for movement in an axial direction in response to rotation of the threaded portion of the slip clutch interconnection; and at least one latch connected to the transverse connecting member and selectively engageable with the modular subassembly of electronic equipment, said latch being configured to selectively urge the modular subassembly in either of the mating and unmating directions and for holding the modular subassembly in a mated condition.

19. An apparatus as in claim 18 wherein the slip clutch interconnection is operative to slip relative to the rotatable drive means only in response to forces encountered during mating.

* * * * *